United States Patent [19]

Nystrom

[11] 3,956,892

[45] May 18, 1976

[54] FUEL-AIR REGULATING SYSTEM FOR HOT GAS ENGINES

[75] Inventor: Per Henrik Nystrom, Borensberg, Sweden

[73] Assignee: Forenade Fabriksverken, Eskilstuna, Sweden

[22] Filed: Nov. 13, 1974

[21] Appl. No.: 523,337

[30] Foreign Application Priority Data

Nov. 13, 1973 Sweden ..... 7315235

[52] U.S. Cl. ..... 60/524; 60/517

[51] Int. Cl.[2] ..... F02G 1/06

[58] Field of Search ..... 60/524, 39.28 T, 39.27

[56] References Cited

UNITED STATES PATENTS 3,782,120 1/1974 Bradenburg ..... 60/524

*Primary Examiner*—Allen M. Ostrager

*Attorney, Agent, or Firm*—Eric Y. Munson

[57] ABSTRACT

A fuel-air regulating system for hot gas engines in which a correctly selected ratio between fuel and air is maintained in spite of variations in the engine load. The system comprises temperature-controlled means for supplying fuel and air required for the combustion in a constant amount per unit of time which exceeds that which the engine requires for maximum power output when the high temperature level of the working gas had dropped to a predetermined lower temperature limit and for reducing the fuel and air supply to a constant amount per unit of time which is less than the amount required at idling of the engine when the temperature of the working gas has reached its predetermined upper limit.

3 Claims, 1 Drawing Figure

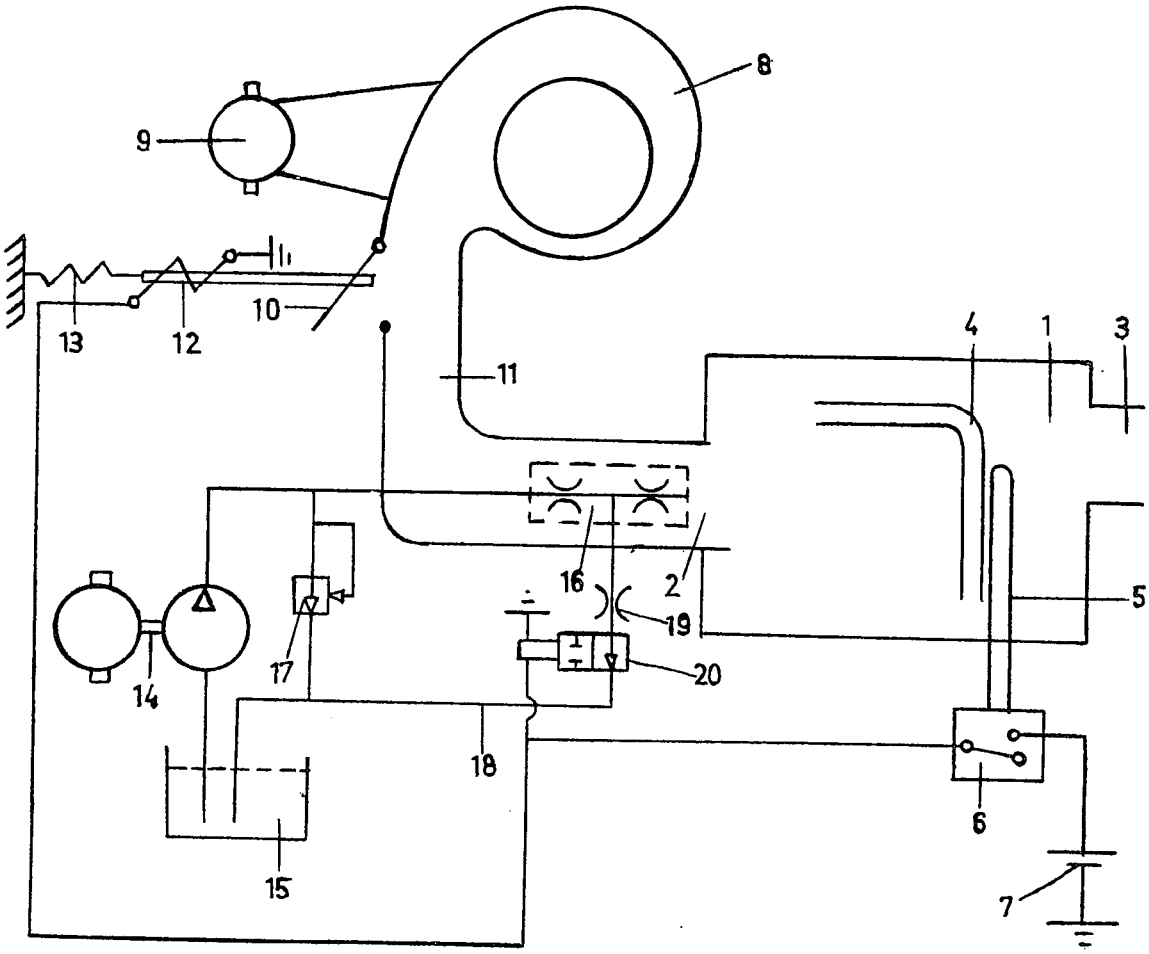
8
9
10
11
12
13
4
1
3
5
2
16
19
20
17
14
18
6
15
7

FUEL-AIR REGULATING SYSTEM FOR HOT GAS ENGINES

BACKGROUND OF THE INVENTION

The present invention relates to a fuel-air regulating system for hot gas engines, in which the high temperature level of the working gas is allowed to vary between fixed upper and lower limits with small deviations above and below a predetermined temperature.

The working principle of the hot gas engine is based on the concept of compressing an enclosed volume of gas at a reduced temperature and expanding it at relatively elevated temperatures. In practice, certain engine parts are continuously heated by an external heat source, while other engine parts are being continuously cooled, the gas volume oscillating between said parts during its passage through a regenerator.

A change of the engine power output brings about a corresponding change of the heat transfer. Consequently, a decrease of the engine power output results in a temperature increase in the hot parts of the engine.

From efficiency point of view it is desirable to keep the elevated temperature level of the engine as high as the construction materials permit. Consequently, a temperature increase above a predetermined optimum level must produce a rapid decrease of the external heat supply, and, conversely, a temperature decrease below a predetermined minimum level must result in an increase of the heat flow.

Normally, the heat is generated from the combustion of a fuel and air. The fuel-air regulating system must be constructed with consideration to the above mentioned requirements, and it constitutes an important factor in production costs of the engine.

SUMMARY OF THE INVENTION

The object of the present invention is to produce a fuel-air regulating system for hot gas engines that is considerably simpler and less costly than systems heretofore known. The system according to the invention comprises a means for supplying fuel as well as air for the combustion, either in a constant amount per unit of time that exceeds that which the engine requires at maximum delivered power or in a constant amount per unit of time that is less than the amount required by the engine at idling. Furthermore, the invention contemplates temperature controlled means for regulating the supply of fuel and air to said first mentioned amounts when the high temperature level of the working gas has dropped to its lower limit below the desired temperature, and for reducing the supply of fuel and air to said last-mentioned amounts when the temperature of the working gas has risen to its upper limit above the desired temperature.

BRIEF DESCRIPTION OF THE DRAWING

The single view shows a fuel-air regulating system for hot gas engines according to the invention.

DESCRIPTION OF A PREFERRED EMBODIMENT

A hot gas engine combustion chamber 1 is provided with a nozzle 2 for supplying a mixture of fuel and air and has an exhaust pipe 3 for the removal of exhaust gases.

The combustion chamber 1 comprises a number of heater tubes 4, only one of which is shown schematically in the drawing. The heater tubes 4 contain a working gas, for instance high pressure helium or hydrogen gas. A temperature sensor 5 is designed to sense the temperature of the heater tubes 4 and consequently the temperature of the working gas. The sensor 5 actuates a switch 6 which is effective either to close or to break an electric circuit from a battery 7. In the position shown, the circuit is broken, as the result of excessive high temperature of the heater tube 4. When the temperature drops below a certain predetermined degree, the switch 6 will move to a position in which the circuit is closed.

The combustion air supplied to the nozzle 2 is pressurized by means of a blower 8, which is driven by means of an electric motor 9 at a substantially constant speed. The amount of air being supplied can be regulated in two steps by the opening or closing of a door 10 in a channel 11 between the blower 8 and the nozzle 2. The door 10 is moved by a solenoid 12 in the closing direction and by a recoil spring 13 in the opening direction. The solenoid 12 is part of a circuit which includes the switch 6. Therefore, in the position of the switch 6 as shown, the door 10 is retained in open position by the recoil spring 13.

An electric fuel pump 14 draws liquid fuel from a tank 15 to a pressure atomizing means 16 in the nozzle 2. A by-pass valve 17 in the supply line from the fuel pump ensures constant fuel supply under constant pressure. A by-pass passage 18 leads from the pressure atomizing means 16 back to the tank 15. The by-pass passage 18 comprises a throttled portion 19 and an electro-magnetic valve 20 which is designed to alternatively assume an open and a closed position. The electro-magnetic valve is actuated by means of an electric circuit, which also includes the switch 6 and the battery 7. In the nonactivated position shown, the electro-magnetic valve 20 is open. If the switch 6 should move to the closed position, the electro-magnetic valve 20 will close off the passage 18.

The regulating system operates as follows:

In the position of the switch 6 as shown, a certain amount of fuel is returned to the tank from the pressure atomizing means 16, which consequently delivers a smaller constant amount of fuel per unit of time. In view of the fact that the door 10 is open, air for combustion consequently is also supplied in a smaller constant amount per unit of time. The amounts of fuel and air may be either of such a magnitude that a fuel-air ratio suitable for complete combustion of high efficienty is obtained, and at the same time of such a magnitude that the generated heat is only somewhat less than is necessary for the hot gas engine to idle. As a consequence the heater tube temperature will decrease, and when a predetermined reduced temperature is reached, the sensor 5 will actuate the switch 6, to close the circuit to the battery 7. The electro-magnetic valve 20 will now close off the fuel by-pass passage. Fuel will thus be supplied in a larger but constant amount per unit of time from the pressure atomizing means 16. At the same time the solenoid 12 will close the door 10 so that air will be supplied to the nozzle 2 in a larger amount also.

The ratio between the larger air and fuel amounts is likewise of such a magnitude that a favorable combustion is achieved. The amounts are so large that the heat being generated is somewhat greater than is necessary for maximum engine power output. Consequently, the temperature of the heater tubes will increase, until the sensor 5 produces a signal to change the switch 6 to re-open the circuit.

The described system thus provides only two heat generation levels, and it becomes easy to secure by simple means a proper ratio between fuel and air under all engine loads. A variation of the engine load will only result in different relationships between the lengths of the time periods during which high and low heat generation occurs.

What is claimed is:

1. A system for regulating the supply of air and fuel to the combustion chamber of a hot gas engine operating in two heat generating modes to permit the high temperature level of the working gas in said combustion chamber to vary between a predetermined upper limit and a predetermined lower limit with small deviations above and below a predetermined temperature, comprising:

a. means for supplying a mixture of fuel and air to the combustion chamber; and b. temperature controlled means effective to increase the supply of said mixture to a constant quantity per unit of time that exceeds that required by the engine for maximum output when the high temperature level of the working gas has dropped to its lower limit below the desired temperature and to reduce the supply of said mixture to a constant quantity per unit of time that is less than that required for the idling of the engine when the temperature of the working gas has reached its upper limit above the desired temperature.

2. A system according to claim 1, in which said temperature controlled means includes an electric circuit and switch means operative to open and break said circuit in response to the temperature of the working gas in relation to the predetermined upper temperature limit and the predetermined lower temperature limit.

3. A system according to claim 2, in which said fuel and air supply means includes by-pass means responsive to said temperature controlled means to maintain a pre-selected fuel and air ratio constant independent of variations in power load on the engine.

* * * * *